US007987015B2

(12) United States Patent
Fähnle et al.

(10) Patent No.: US 7,987,015 B2
(45) Date of Patent: Jul. 26, 2011

(54) METHOD AND APPARATUS FOR MANUFACTURING OPTICAL ELEMENTS

(75) Inventors: Oliver Fähnle, St. Gallen (CH); Wilhelmus Messelink, St. Gallen (CH); Mark Meeder, St. Gallen (CH)

(73) Assignee: Fisba Optik AG, St. Gallen (CH)

( * ) Notice: Subject to any disclaimer, the term of this patent is extended or adjusted under 35 U.S.C. 154(b) by 514 days.

(21) Appl. No.: 12/062,074

(22) Filed: Apr. 3, 2008

(65) Prior Publication Data

US 2008/0248729 A1 Oct. 9, 2008

(30) Foreign Application Priority Data

Apr. 4, 2007 (CH) ..... 0541/07

(51) Int. Cl.
*G06F 19/00* (2011.01)
*B24B 1/00* (2006.01)
*B24C 1/00* (2006.01)

(52) U.S. Cl. ..... 700/164; 451/40; 451/42; 707/999.201; 700/117; 700/159; 700/160

(58) Field of Classification Search ..... 700/164, 700/117, 159, 160; 451/40, 42; 707/201, 707/999.201
See application file for complete search history.

(56) References Cited

U.S. PATENT DOCUMENTS

| | | | | |
|---|---|---|---|---|
| 3,928,154 | A * | 12/1975 | Andrews | 205/654 |
| 4,383,572 | A * | 5/1983 | Bellows | 165/5 |
| 5,496,689 | A * | 3/1996 | Ogawa | 430/505 |
| 5,971,835 | A * | 10/1999 | Kordonski et al. | 451/38 |
| 6,123,801 | A * | 9/2000 | Miller | 156/344 |
| 6,422,920 | B1 * | 7/2002 | Bouten et al. | 451/29 |
| 6,604,986 | B1 * | 8/2003 | Fahnle | 451/38 |
| 7,530,880 | B2 * | 5/2009 | Bajaj et al. | 451/5 |
| 2001/0018323 | A1 * | 8/2001 | Mulroy et al. | 451/406 |
| 2002/0173238 | A1 * | 11/2002 | Kordonski et al. | 451/36 |
| 2003/0060132 | A1 * | 3/2003 | Kurogouchi | 451/20 |
| 2004/0221877 | A1 * | 11/2004 | Bergman | 134/34 |
| 2005/0103271 | A1 * | 5/2005 | Watanabe et al. | 118/719 |
| 2006/0141911 | A1 * | 6/2006 | Fahnle | 451/75 |
| 2008/0142050 | A1 * | 6/2008 | Hashish et al. | 134/22.12 |
| 2009/0117828 | A1 * | 5/2009 | Hongo et al. | 451/6 |

FOREIGN PATENT DOCUMENTS

| | | |
|---|---|---|
| WO | 01/12386 | 2/2001 |
| WO | 02/49804 | 6/2002 |

* cited by examiner

*Primary Examiner* — Albert Decady
*Assistant Examiner* — Jason Lin
(74) *Attorney, Agent, or Firm* — Shoemaker and Mattare

(57) ABSTRACT

In a method for producing optical elements, material on a blank (20) is removed with an abrasive liquid jet (32). The liquid jet (32) has a jet thickness (d) which is greater than the dimension (D) of the blank (20) in a plane (E) perpendicular to the direction (R) of the liquid jet. Predefined removal profiles in aspherical form can be achieved by the liquid jet (32) being guided onto the blank (20) at different angles of incidence (α).

21 Claims, 4 Drawing Sheets

METHOD AND APPARATUS FOR MANUFACTURING OPTICAL ELEMENTS

Figure 1:
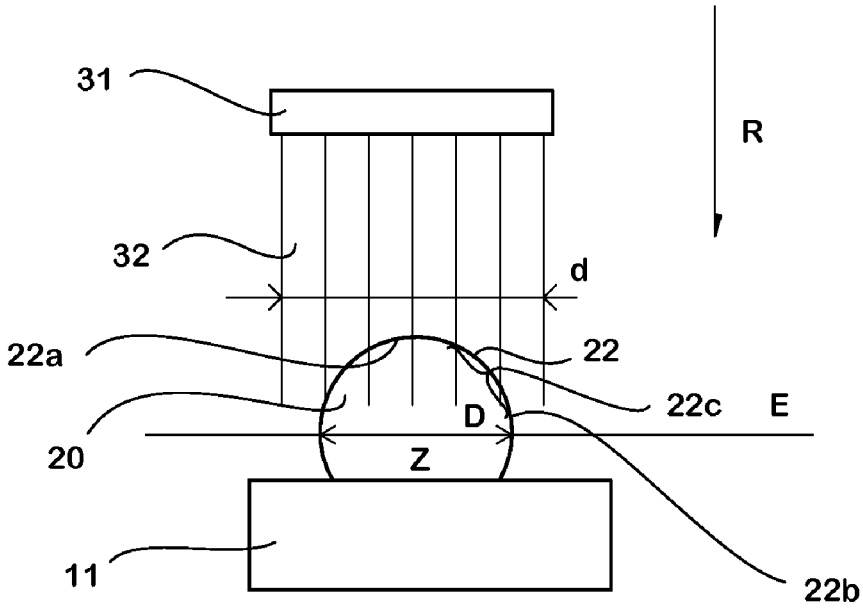

The invention relates to a method and an apparatus for producing optical elements according to the features of the preamble of the independent patent claims.

In order to polish, correct or machine optical elements, it is known to remove material by using an abrasive liquid jet. In this technique, called fluid jet polishing, it is possible to shape and to polish optical surfaces, for example of glass bodies. The fluid jet polishing technique is described, for example, by O. W. Fähnle/H. van Brug/H. J. Frankena in "Fluid Jet Polishing of optical surfaces", Applied Optics 37 (28), 6771-6773, 1998.

For optical applications, such as DVD systems, or for laser optics for coupling into optical fibres, aspherical lenses having very small dimensions are needed.

With currently known production methods, it is difficult to produce such small mini or micro lenses with adequate precision. Here and in the following text, mini and micro lenses are understood to be lenses which have a diameter from 0.1 to 5 mm. It is therefore an object of the present invention to avoid the disadvantages of the known, in particular therefore to devise a method and an apparatus by means of which aspherical mini and micro lenses can be produced with high precision in a straightforward manner. The apparatus according to the invention and the method according to the invention are additionally intended to permit the production of such lenses in a flexible way.

According to the invention, these objects are achieved by a method and an apparatus having the features of the characterizing part of the independent patent claims.

The method is used to produce optical elements. In particular aspherical mini and micro lenses are intended to be produced therewith. However, it is also conceivable to produce other optical elements having small dimensions in accordance with the invention.

In a first step of the method, a blank is provided. The blank consists of a transparent material, typically of glass. The blank is machined with an abrasive liquid jet. As a result, material is removed from the blank.

According to the invention, the liquid jet has a jet diameter which is greater than the dimension of the blank in a plane perpendicular to the direction of the liquid jet. The blank typically has a size of 0.1 to 5 mm. In principle, the method according to the invention also functions in the case of larger diameters, provided that an abrasive jet having a sufficiently large diameter is made available. It has been shown that, in this case, a specific, inhomogeneous removal profile is produced on the surface of the blank. This profile depends, inter alia, on the different angles of incidence of the jet at the various points of the blank, in particular a spherical blank. If such a relatively large liquid jet is used, the typical spherical surface of the blank is removed irregularly, particularly made aspherical.

For the machining of the blank, according to the invention the liquid jet is guided against the blank at at least two different angles of incidence in such a way that a predetermined removal profile is produced.

Machining is preferably carried out on a blank which is spherical, at least in the region of the surface to be machined. Starting from the spherical shape of the blank, the desired profile or the desired asphericity can be achieved particularly simply on the basis of the difference between the desired shape and the shape of the blank.

It is also conceivable, in specific applications, to use other shapes of blanks, for example including cylindrical blanks.

The method according to the invention is carried out in accordance with the principle of fluid jet polishing, known per se. In this case, the liquid used is typically water in which $CeO_2$ or SiC or other commercially available grinding or polishing agents are mixed as abrasive material.

The blanks typically have dimensions of a few tenths of a millimeter. According to the invention, the liquid jet has a jet diameter of about 1-6 mm. Typically, the jet is delivered with a delivery pressure of 5 to 20 bar and strikes the surface of the blank with a velocity of 40 to 80 m/s.

Particularly preferably, the jet and the blank are moved in relation to each other in such a way that the jet is rotated about the center of the at least partly spherical blank. In this way, predetermined removal profiles based on a spherical blank can be predicted particularly accurately.

In the process, the blank is particularly preferably brought into a predetermined shape by a desired removal profile being formed as a difference between the shape of the blank and the desired shape as a combination of a plurality of basic removal profiles. In this case, each basic removal profile corresponds to the machining of the blank at a predetermined angle of incidence of the liquid jet. The desired removal profile can therefore be produced as a linear combination of a plurality of such basic removal profiles. This combination of the removal profiles represents the physical deviation of the desired optical element, in particular the aspherical lens, from the blank, in particular from the basic sphere. By means of the determination of the removal rate and/or of the removal profile at different angles of incidence, for example separated from one another by 10°, a set of basic removal profiles can be determined. The removal profile of the blank is then put together as a linear combination of the basic removal profiles. In addition, it is preferably possible, starting from a known removal profile at an angle of 0°, to simulate the further basic profiles for any desired angle of impingement. This makes it possible, by using a single stored removal profile (for an angle of impingement of 0°), to simulate the further basic profiles without having to carry out measurements. The desired removal rate can be produced simply from a linear combination of the simulated basic profiles. It is therefore also readily possible to determine and select basic profiles having particularly suitable angles of impingement. It is therefore not necessary to proceed on the basis of fixed angular positions with fixed spacings. Therefore, optimised angles can be selected, so that the asphere can also be produced with minimal residence times.

The apparatus according to the invention is used to produce optical elements, typically aspherical mini and micro lenses. The apparatus has a holding arrangement for at least one blank. The apparatus is additionally provided with a jet apparatus for discharging an abrasive liquid jet. The jet apparatus is constructed for discharging a liquid jet which has a jet diameter which is greater than the dimension of the blank in a plane perpendicular to the direction of the liquid jet. The jet apparatus for discharging the abrasive liquid jet and the holding apparatus can be moved in relation to each other in such a way that the liquid jet strikes the blank at different angles of incidence. The holding arrangement can preferably be moved with the blank. This type of mutual movement is particularly simple, since it is sufficient to move the holding apparatus in such a way that the blank moves around its centre. However, it is in principle also conceivable to move only the jet apparatus or the jet apparatus and the holding arrangement for the blank. Although the control of movement is somewhat more complex in this case, it can readily be implemented with a CNC controller.

The holding apparatus is preferably designed to accommodate a blank having a size of 0.1-5 mm.

The jet apparatus is typically constructed to produce a liquid jet having a delivery pressure of 5 to 20 bar and with an impingement velocity of the liquid jet on the blank of 40 to 80 m/s.

The apparatus is additionally preferably provided with a computer arrangement, by means of which the relative position between the direction of the liquid jet and the position of the holding apparatus of the blank can be adjusted. In this way, a desired removal profile can be set up particularly simply under automatic control.

In particular, the computing means can be constructed to determine a combination of predefined basic removal profiles in order to produce a desired removal profile. To this end, a plurality of basic removal profiles are advantageously stored in the apparatus according to the invention and assigned to individual angles of incidence.

The invention additionally relates to a computer program product which contains a plurality of predefined basic removal profiles, which are assigned to different angles of incidence of an abrasive liquid jet under predetermined conditions such as glass type, size of the blank, properties of the jet. According to the invention, the computer program carries out the method described above for producing optical elements in the previously described apparatus when the program runs on a computer.

Figure 2:
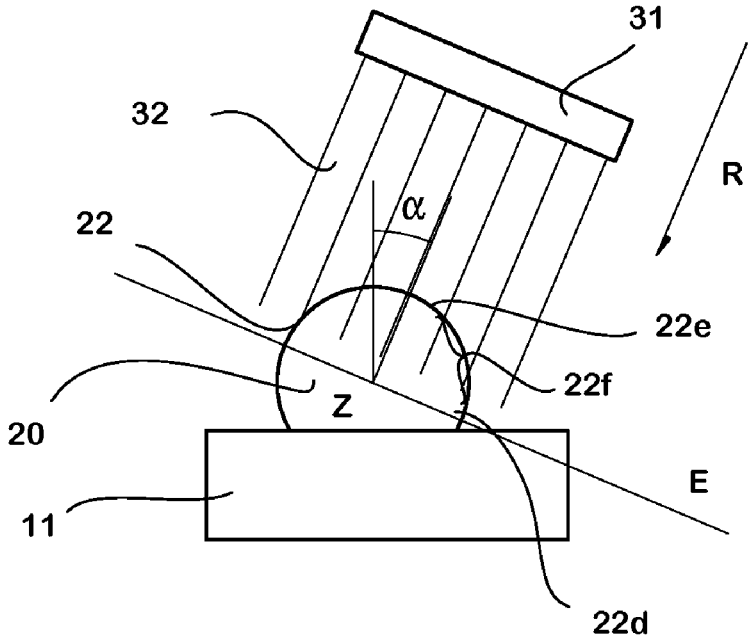
Figure 3:
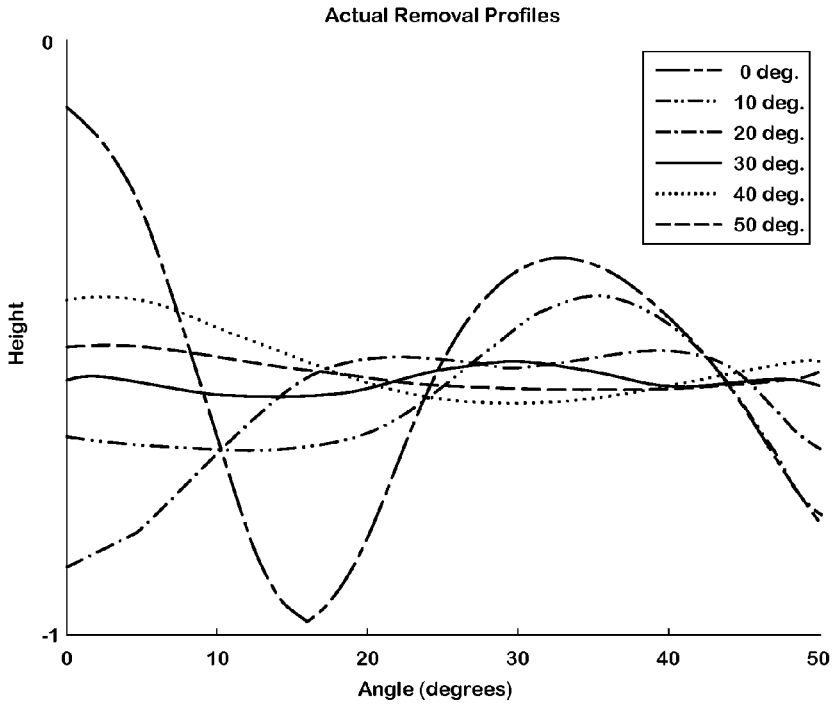
Figure 4:
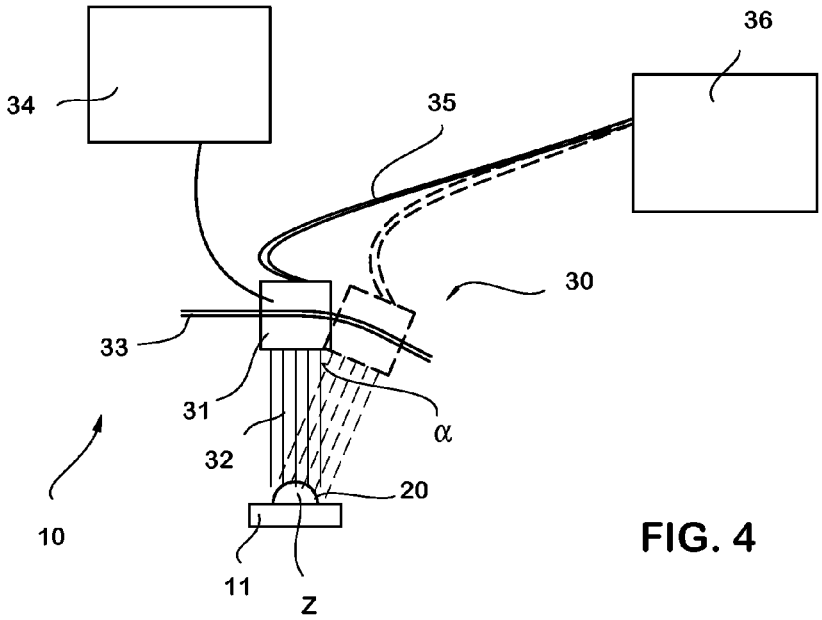
Figure 5:
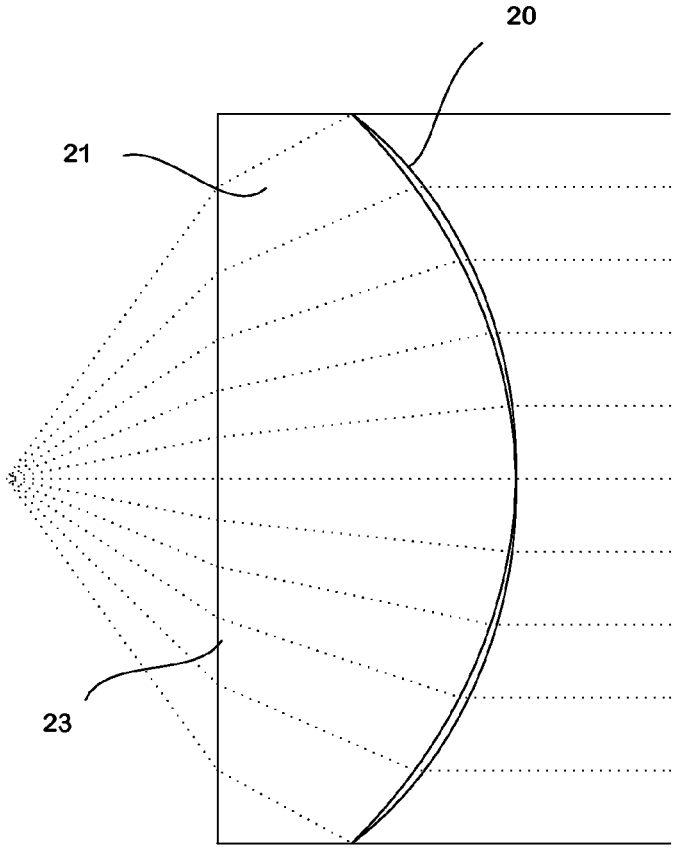
Figure 6:
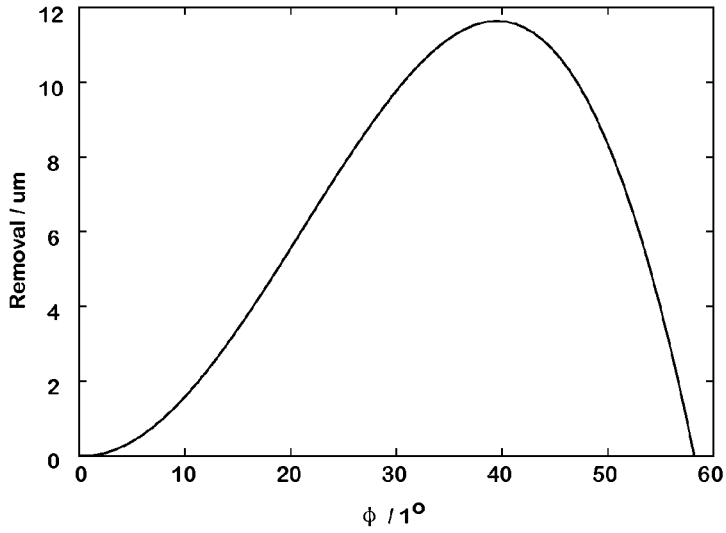
Figure 7:
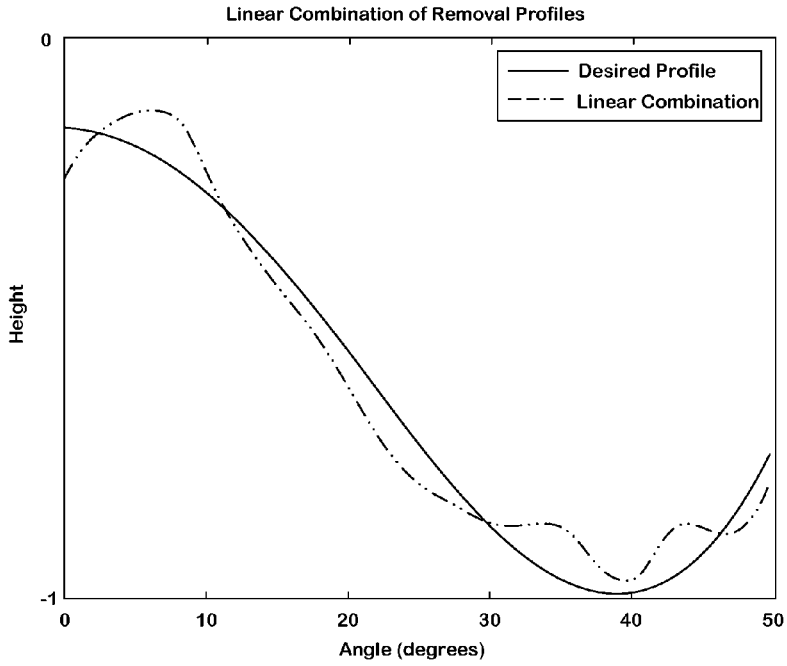
Figure 8:
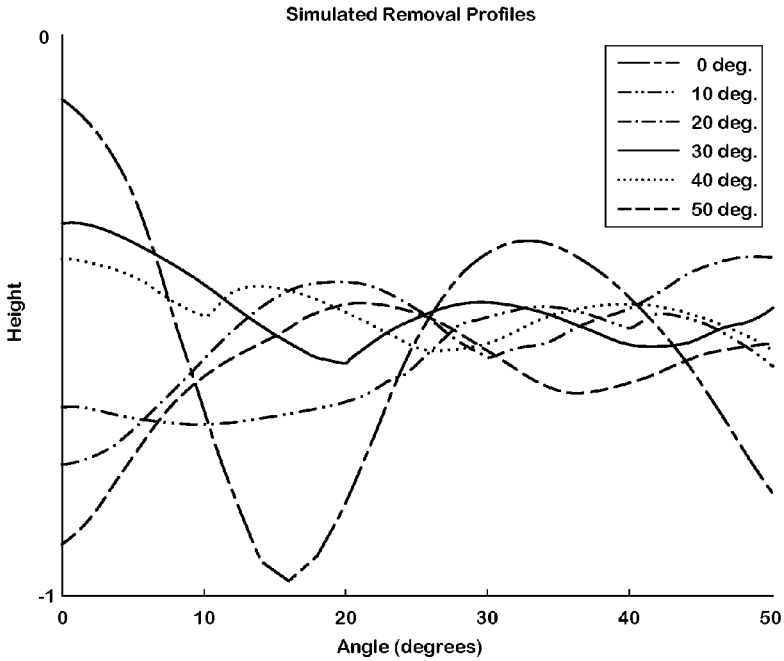

The invention will be described in more detail below by using the drawings and in exemplary embodiments. In the drawings:

FIG. 1 shows a schematic illustration of the production of a specific removal profile at a first angle of incidence FIG. 2 shows a schematic illustration of the production of a removal profile at a second angle of incidence FIG. 3 shows a graph relating to the measurement of various removal profiles at different angles of incidence FIG. 4 shows a schematic illustration of an apparatus according to the invention FIG. 5 shows a schematic illustration of a blank and a lens FIG. 6 shows an illustration of the computation of the optics of a lens FIG. 7 shows a comparison of an intended removal profile with a linear combination of basic profiles and FIG. 8 shows a graph of removal profiles produced by means of simulation at various angles.

FIGS. 1 and 2 show the basic principle of the present invention in schematic form. A blank 20 in the form of a part sphere is mounted in a holding arrangement 11. The blank 20 is a glass blank with a radius of 0.45 mm, that is to say a diameter D of 0.9 mm. By means of an abrasive liquid jet 32, material is removed from the surface 22 of the blank 20. The abrasive liquid jet 32 is discharged by a nozzle 31. In FIG. 1, the liquid jet 32 is oriented in a direction R which is approximately perpendicular to the surface of the mount 11. The angle between the vertical and the direction R of the liquid jet is 0°. The abrasive liquid jet 32 has a jet diameter d which is about 1.5 mm. The jet diameter d is therefore greater than the diameter D of the blank in a plane E perpendicular to the direction R of the liquid jet. This results in different removal rates in different surface regions of the blank 20. For example, in first surface regions 22*a* and 22*b*, in particular, in which the liquid jet 32 strikes the blank 20 vertically or parallel, the removal is low. The rate is higher in a second surface region 22*c*, in which the liquid jet strikes the surface at an angle between 0° and 90°. The result is a removal that depends on the surface region of the blank and, as a result, a specific removal profile.

In FIG. 2, the blank 20 has been pivoted in relation to the nozzle 3 and its center Z, so that an angle α of about 10° results between the direction R of the liquid jet 32 and the vertical L. In this situation according to FIG. 2, the removal rate is highest in the surface region 22*f*, while the removal rate in the regions 22*e* and 22*d* is virtually zero. During the machining of the blank 20 with a position of the nozzle 31 according to FIG. 2, the result is therefore a different removal profile on the blank 20.

By means of further variations of the position of the nozzle 31, a large number of different removal profiles can be produced. FIG. 3 shows various removal profiles at six different angles of incidence α of the liquid jet 32. FIG. 3 in each case shows only half the profile (i.e. the removal profile from a central plane of the blank as far as an angle of 50° in relation to the central plane). The X axis from 0 to 50° corresponds to the measuring range of an interferometer, by means of which the removal profiles were measured. Along the Y axis, the relative normalised material removal at right angles to the surface of the sphere, starting from a spherical blank 20, is illustrated.

As FIG. 3 shows, different removal profiles result, depending on the angular position of the liquid jet 32. A combination of these individual basic removal profiles can be determined in advance by computation in order to produce a predefined removal profile. This removal profile corresponds to the difference between the shape of the blank 20 and the desired aspherical shape of the optical component to be produced, in particular a lens.

FIG. 4 shows an apparatus 10 according to the present invention in schematic form. The apparatus 10 substantially comprises a holding arrangement 11 for holding the blank 20. During operation, attention must be paid in particular to the centering of the blank. The relative movement between the blank 20 and the nozzle 31 must take place very accurately about the center of the blank. To this end, the blank is held in such a way that at least half thereof projects out of the holding arrangement 11 and can be acted on by the liquid jet.

The liquid jet 32 can be discharged through the nozzle 31 as part of a jet apparatus 30. The nozzle 31 is mounted with a nozzle mount 33 such that it can move, so that the liquid jet 32 can be pivoted about the centre Z of the blank 20. According to one exemplary embodiment, a blank was held such that it could move in three translational axes in the X, Y and Z direction. The rotational movements were produced by the nozzle 31. The control of the individual movements was carried out by a high-precision CNC machine. However, other arrangements are of course also conceivable, in which, for example, only the holding arrangement 11 for holding the blank 20 would be pivoted.

The nozzle 31 is connected in a manner known per se via a liquid connection 35 to an apparatus 36 for producing an abrasive liquid jet. This is typically a volumetric pump.

In addition, the apparatus 10 has a computer arrangement 34. Various basic removal profiles are stored in the computer arrangement 34. The basic removal profiles in each case correspond to the removal profile for a specific angle of incidence α of the liquid jet 32 on the blank 20. For predetermined operating conditions (material and size of the blank, type of liquid jet), in each case a removal profile is stored for a plurality of various angles. By means of the computer arrangement 34, a desired removal profile can be calculated as a difference between the shape of the blank and the shape of the desired aspherical component, by means of a linear combination of various basic removal profiles. The computer arrangement 34 controls the position of the nozzle 31 appropriately via a CNC machine.

The nozzle 32 can be pivoted in the mount 33 by an angle α in relation to the centre Z of the blank 20 (illustrated dashed). Typically, predetermined angular positions at intervals of 5° or 10° are conceivable. Alternatively, it is also conceivable to use angular positions at irregular intervals which optimise the production process, in particular minimise residence times per angular region. The determination of profiles in the diverse angular positions can be carried out in this case on the basis of simulations starting from a real basic profile. In this case, a real measurement in specific angular positions is therefore not necessary.

The removal profile corresponds to the difference from a partially spherical blank 20. The rear side 23 of the blank is ground flat, preferably before the blank is positioned in the holding arrangement.

The computation of the optics of the lens, that is to say the difference between the spherical shape of the blank and the aspherical shape of the lens 21, is illustrated in FIG. 6. The difference corresponds to the intended removal profile. Depending on the angular position (0°=center of the lens, about 58°=outer edge of the lens), different removal amounts in the range between zero and at most 12 μm are envisaged. This results in the aspherical shape.

In FIG. 7, a comparison between a desired removal profile (desired profile) and a linear combination of basic removal profiles, which form an approximation to the desired profile, is shown in schematic form. The removal rate has been normalized (maximum removal corresponds to −1).

Using known removal profiles (actual removal profiles for 0°, 10°, 20°, 30°, 40° and 50° of the angle of incidence of the jet on the blank), a linear combination was determined with which the intended profile can be approximated as well as possible. This linear combination is illustrated in FIG. 7 in comparison with the intended profile. Typically, in order to achieve the profile illustrated in FIG. 7, machining was calculated as follows from a linear combination:

| Residence time/normalized to total time | Basic profile | use |
|---|---|---|
| 0 | 0° profile | no |
| 0 | 10° profile | no |
| 0.0851 | 20° profile | yes |
| 0.1501 | 30° profile | yes |
| 0 | 40° profile | no |
| 0.7647 | 50° profile | yes |

In the actual (calculated) example, removal amounts with an angle of incidence of 20°, 30° and 50° are therefore proposed. The residence time of the removal of the profile which is produced by angles of incidence of 50° is 76%. The machining time for removal amounts with an angle of incidence of 20° and 30°, respectively, is 8.5% and 15%. The exemplary embodiment shown was carried out in theory by means of simulation. The profile could be produced in practice in a corresponding way.

In FIG. 8, an alternative exemplary embodiment is shown. Instead of the measured basic profiles illustrated in FIG. 3, the example according to FIG. 8 is based on simulated basic profiles, which are calculated on the basis of a measurement for an angle of incidence of 0°. The differences between the simulated and the measured basic profiles are sufficiently low that a corresponding lens could also be produced on the basis of such simulated profiles. The advantage in this case is that any desired profiles can therefore also be calculated for different angles of incidence.

The invention claimed is:

1. Method for producing optical elements, including steps of:

providing at least one blank, machining the blank with an abrasive liquid jet in order to remove material from the blank, wherein the liquid jet has a jet diameter which is greater than the dimension of the blank in a plane perpendicular to the direction of the liquid jet and wherein, during the step of machining of the blank, the liquid jet is aimed at the blank at least two different angles of incidence in such a way that a desired removal profile is achieved.

2. Method according to claim 1, wherein a blank is used which is at least partly spherical in the region of the surface to be machined.

3. Method according to claim 1, wherein the liquid of the liquid jet is water.

4. Method according to claim 1, wherein $CeO_2$ or SiC is added to the liquid jet as abrasive material.

5. Method according to claim 1, wherein the liquid jet has a jet diameter of 1-6 mm.

6. Method according to claim 1, wherein the blank has a diameter of 1 to 5 mm.

7. Method according to claim 1, wherein the abrasive liquid jet is delivered with a delivery pressure of 5 to 20 bar in a delivery arrangement.

8. Method according to claim 1, wherein the liquid jet strikes the surface of the blank that is to be machined with a velocity of 40 to 80 m/s.

9. Method according to claim 2, wherein the machining of the blank at various angles of the liquid jet is carried out by a holding arrangement for the blank being pivoted about the center of the at least partly spherical blank.

10. Method according to claim 1, wherein the blank is machined by material being removed from the blank in accordance with a removal profile, the removal profile being formed as a combination of a plurality of basic removal profiles and each basic removal profile corresponding to the machining of the blank at a predetermined angle of incidence of the liquid jet on the blank.

11. Method according to claim 10, wherein a first basic profile is a measured basic profile for the machining of the blank at a first angle of incidence, and in that further basic removal profiles for further predetermined angles of incidence are calculated by means of simulation on the basis of the first basic profile.

12. Method according to claim 11, wherein the predetermined angles of incidence of the simulated basic profiles are selected from a linear combination of the simulated basic profiles.

13. Apparatus for producing optical elements, having a holding arrangement for at least one blank, a jet apparatus for discharging an abrasive liquid jet, wherein the jet apparatus for discharging the abrasive liquid jet is constructed in such a way that a liquid jet can be produced which has a jet diameter which is greater than the dimension of the blank in a plane perpendicular to the jet direction of the liquid jet, and wherein the jet apparatus for discharging the abrasive liquid jet and the holding apparatus for the blank can be moved in relation to each other in such a way that the liquid jet strikes the blank at least two different angles of incidence.

14. Apparatus according to claim 13, wherein the holding apparatus is designed to accommodate a blank with a diameter of <5 mm.

15. Apparatus according to claim 13, wherein the jet apparatus is designed to produce a liquid jet with a jet diameter of 1-6 mm.

16. Apparatus according to claim 13, wherein the jet apparatus is designed to produce an abrasive liquid jet which strikes the surface of the blank that is to be machined with a velocity of 40 to 80 m/s.

17. Apparatus according to claim 13, wherein the apparatus has computer means by means of which the relative position of the direction of the liquid jet in relation to the mount of the blank can be adjusted.

18. Apparatus according to claim 17, wherein the computer means are designed to determine a combination of predefined basic removal profiles in order to produce a desired removal profile.

19. Apparatus according to claim 18, wherein a plurality of basic removal profiles which are associated with the machining of a blank at a specific angle of incidence of the liquid jet are stored in the apparatus.

20. Apparatus according to claim 18, wherein a basic removal profile for a first removal angle is stored in the apparatus, and in that the apparatus is designed to calculate a plurality of further basic removal profiles for further specific angles of incidence of the liquid jet by means of simulation.

21. A computer readable medium encoding a computer program product, in which at least one basic removal profile is stored which corresponds to the material removal of a blank at a specific angle of incidence of a liquid jet on the surface of the blank, the computer program product carrying out a method for producing optical elements in an apparatus for producing optical elements when the computer program product runs on a computer, wherein:

the method includes a step of machining the blank with an abrasive liquid jet in order to remove material from the blank;

the liquid jet has a jet diameter which is greater than the dimension of the blank in a plane perpendicular to the direction of the liquid jet; and for the machining of the blank, the liquid jet is aimed at the blank at least two different angles of incidence in such a way that a desired removal profile is achieved.

* * * * *